United States Patent [19]

Bohnhoff et al.

[11] 4,345,845

[45] Aug. 24, 1982

[54] DRIVE CIRCUIT FOR THERMAL PRINTER

[75] Inventors: Alan E. Bohnhoff, Lexington, Ky.; Bruce M. Cassidy, Fairfax, Va.; Stanley Dyer, Lexington, Ky.

[73] Assignee: International Business Machines Corporation, Armonk, N.Y.

[21] Appl. No.: 275,183

[22] Filed: Jun. 19, 1981

[51] Int. Cl.[3] ..... B41J 3/02

[52] U.S. Cl. ..... 400/120; 346/76 PH; 101/DIG. 2

[58] Field of Search ..... 400/119, 120, 237; 346/76 PH; 219/216; 101/DIG. 2

[56] References Cited

U.S. PATENT DOCUMENTS

| | | | |
|---|---|---|---|
| 2,713,822 | 7/1955 | Newman | 101/DIG. 2 |
| 3,119,919 | 1/1964 | Pratt | 101/DIG. 2 |
| 3,132,584 | 5/1964 | Dalton | 101/DIG. 2 |
| 3,744,611 | 7/1973 | Montanari et al. | 400/120 |
| 3,847,265 | 11/1974 | Ehretsmann et al. | 346/76 PH |
| 4,032,925 | 6/1977 | Kos | 346/76 PH |

FOREIGN PATENT DOCUMENTS

| | | | |
|---|---|---|---|
| 28334 | 5/1981 | European Pat. Off. | 400/120 |
| 2527948 | 1/1976 | Fed. Rep. of Germany | 400/120 |

OTHER PUBLICATIONS

Wilbur "Electrothermal Print Head" IBM Tech. Disclosure Bulletin, vol. 23, No. 9, Feb. 1981, pp. 4305–4306.

*Primary Examiner*—E. H. Eickholt

*Attorney, Agent, or Firm*—George E. Grosser

[57] ABSTRACT

An electrode drive configuration for a resistive ribbon thermal printer utilizes as a feedback a monitored signal representative of an internal ribbon voltage at the print point. A monitoring contact is preferably located on the opposite side of the printhead from the drive signal return contact and the feedback signal is used to cancel the effects voltage drop variations in the common return portion of the drive signal path.

11 Claims, 3 Drawing Figures

DRIVE CIRCUIT FOR THERMAL PRINTER

BACKGROUND REGARDING THE INVENTION

1. Field of the Invention

The subject invention relates to circuitry for energizing the printhead of an electrothermal printer.

2. Statement Regarding the Art

One class of thermal printers utilizes a ribbon that generates localized heat internally in response to electrical signals. The localized heat then serves to cause marks to be formed on a receiving medium. Typically, the electrical signals are applied by printhead electrodes wiping across an outer layer of the ribbon that is characterized by a moderate resistivity. These signals migrate inwardly to a layer that is highly conductive (preferably an aluminum layer) with localized heating occurring in the process. The path for the signals is completed by a contact engaging the conducting layer (see, e.g. U.S. Pat. No. 2,713,822) or, alternatively, is completed through the moderately conducting layer at a collection plate (see, e.g. U.S. Pat. No. 3,744,611) where electrical contact is established.

With this type of printer, the signals provided at the electrodes of the printhead cause heating within the ribbon which, in turn, results in a mark being formed. The mark may be produced because of a thermal sensitivity of the paper itself or, as is also known, by a transfer of a portion of an outer thermally transferrable ink layer of the ribbon.

With such "resistive ribbon" printers, print quality has shown undesirable variation when the electrodes are driven by selectively applying a fixed voltage.

It has been found, however, that by using selectively-triggerable current sources to drive the respective printhead electrodes, a satisfactory quality of mark formation may be achieved (see IBM Technical Disclosure Bulletin, Volume 22, No. 2, pp. 790–791).

A shortcoming of the constant-current approach to driving the printhead electrodes arises because individual gated drive circuits are provided for each electrode thereby increasing overall drive circuit complexity and energy consumption.

Indeed, since the current drivers are regulating, rather than merely switching, considerable energy is dissipated making a low cost miniaturized implementation, say in the form of an integrated circuit chip difficult because of cooling requirements.

BRIEF SUMMARY OF THE INVENTION

The subject invention involves a recognition that a significant contributor to printing quality variations for resistive ribbon printers is the voltage drop in the signal return path that includes the "buried" highly conducting layer of the ribbon. Furthermore, it is recognized that a voltage corresponding essentially to a voltage at the buried conducting layer may be monitored at an electrical contact that engages the ribbon at the surface of the resistive outer layer if such a contact is used in conjunction with a high impedance monitoring circuit.

By so monitoring ribbon voltage with a high impedance circuit, insignificant monitoring current flows and, hence, the potential established by the printing currents is not appreciably distorted by ohmic voltage drops resulting from the monitoring current. With the monitoring point spaced from the printhead, no significant contribution to the monitored potential results from the migration of printing current toward the highly conducting layer and it is possible to produce a feedback voltage that essentially corresponds to the conducting layer voltage at the print point. Preferably, the bulk of the drive signal current flows in one direction along the ribbon away from the printhead and the monitoring contact site is located on the ribbon a spaced interval from the printhead in the opposite direction so that all of the potential drop resulting from the flow of printing current in the highly conducting layer is included in the monitored potential. Using this feedback signal, the drive voltage supplied to the electrodes is modified to reduce the sensitivity of the printing process to the return path voltage drop. The feedback signal is preferably used to modify the applied drive voltage so as to effectively cancel out the return path voltage drop.

The feedback circuit preferably operates on the supply voltage ahead of switching gates that select the respective electrodes so that only one drive signal source is required. Equal-sized resistors may be placed in series with the individual electrodes to encourage uniformity of current flow.

In a presently preferred implementation, the drive signal return contact comprises a conducting roller located on the ribbon takeup side of the printhead and the electrical contact for monitoring is a conducting roller located on the ribbon supply side of the printhead.

BRIEF DESCRIPTION OF THE DRAWINGS

The invention is described in detail below with reference to the drawings wherein.

DETAILED DESCRIPTION OF THE INVENTION

The environment of the invention will be initially considered in the context of a prior art, constant-current drive circuit for electrode energization.

Figure 1:
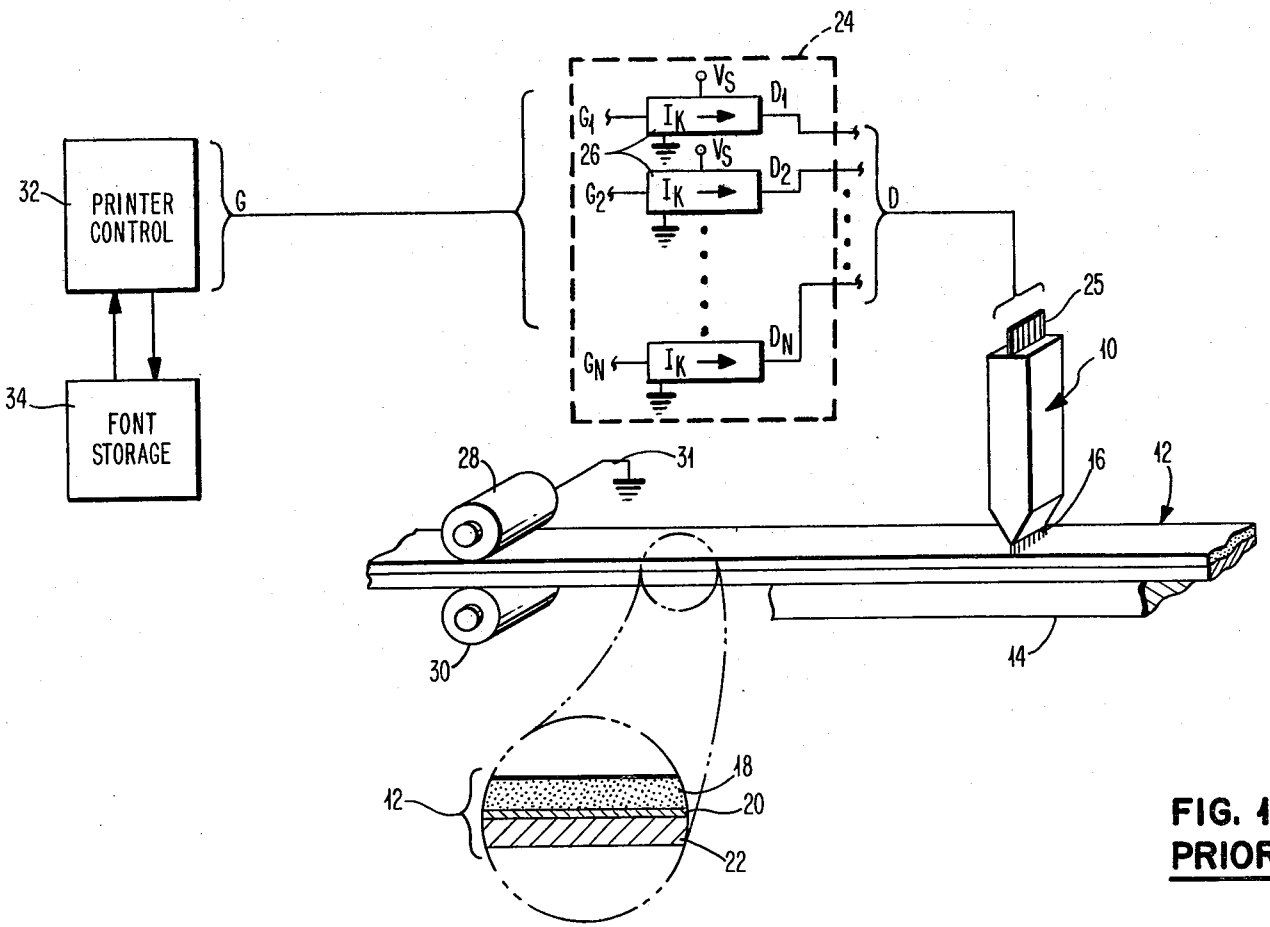
FIG. 1 PRIOR ART
FIG. 1 is a diagram partially in block form indicating the electrode drive arrangement for a resistive ribbon printer.

Referring to FIG. 1, a printhead 10 wipes or scans along a "resistive" ribbon 12 which is in contact with a receiving medium 14, such as paper, on which marks are formed. A set of printing electrodes 16 (a set of "N" electrodes is assumed in the discussion below) contact the resistive ribbon 12 at a printing zone, such contact occurring with the surface of a moderately resistive layer 18 (e.g. a resistance characteristic in a range of 200–400 ohms per square is preferred, but values over a greater range offer a possibility of satisfactory performance). Adjacent the resistive layer 18 is a thin conducting layer 20 which is preferably a thin layer of aluminum. An outer ink layer 22 of thermally transferrable ink is typically formed adjacent to the conducting layer 20. However, if the receiving medium 14 is thermally sensitive, the outer ink layer 22 is not required to form marks.

In operation, printhead energization means 24 applies signals (denoted $D_1$–$D_N$) to the printhead 10 through a set of electrode leads or channels 25 for causing mark formation on the receiving medium 14. A known way to achieve acceptably uniform printing quality involves the use of individual fixed-current drivers 26 (the current is denoted $I_K$ and the preferred direction of conventional current flow is indicated by an arrow) for the respective electrodes 16. The current drivers 26 are energized by a voltage source signal denoted Vs and are triggered by gating signals (denoted $G_1$–$G_N$) to cause selective application of the signals D to the electrodes 16.

Signals D applied at the electrodes 16 tend to migrate through the moderately resistive layer 18 of the resistive ribbon 12 to the conducting layer 20 and cause localized heating in the process. Mark formation results from the localized heating either by a transfer of a portion of the ink layer 22 or by a change in the receiving medium 14 (e.g. with thermally sensitive paper). The signal path for the signals D extends predominantly through the conducting layer 20 to a collection zone where a collector contact 28 engages the ribbon 12. As shown, the collector contact 28 may be a conducting roller that engages the moderately resistive layer 18 and cooperates with a pressure roller 30 to achieve intimate electrical contact. The collector contact 28 is electrically connected through a low-impedance connection 31 to provide for signal return path to the energization means 24. The low-impedance connection 31 may be a ground connection including portions of the printer frame (not shown) or a directly wired connection.

The gating signals G, that control the time intervals for the selective production of the signals D, are generated by a printer control 32 which cooperates with a font storage 34 as is well known for matrix printers. It should be appreciated that this arrangement requires individual current drivers 26 which provide a regulating action that involves significant heat generation.

Figure 2:
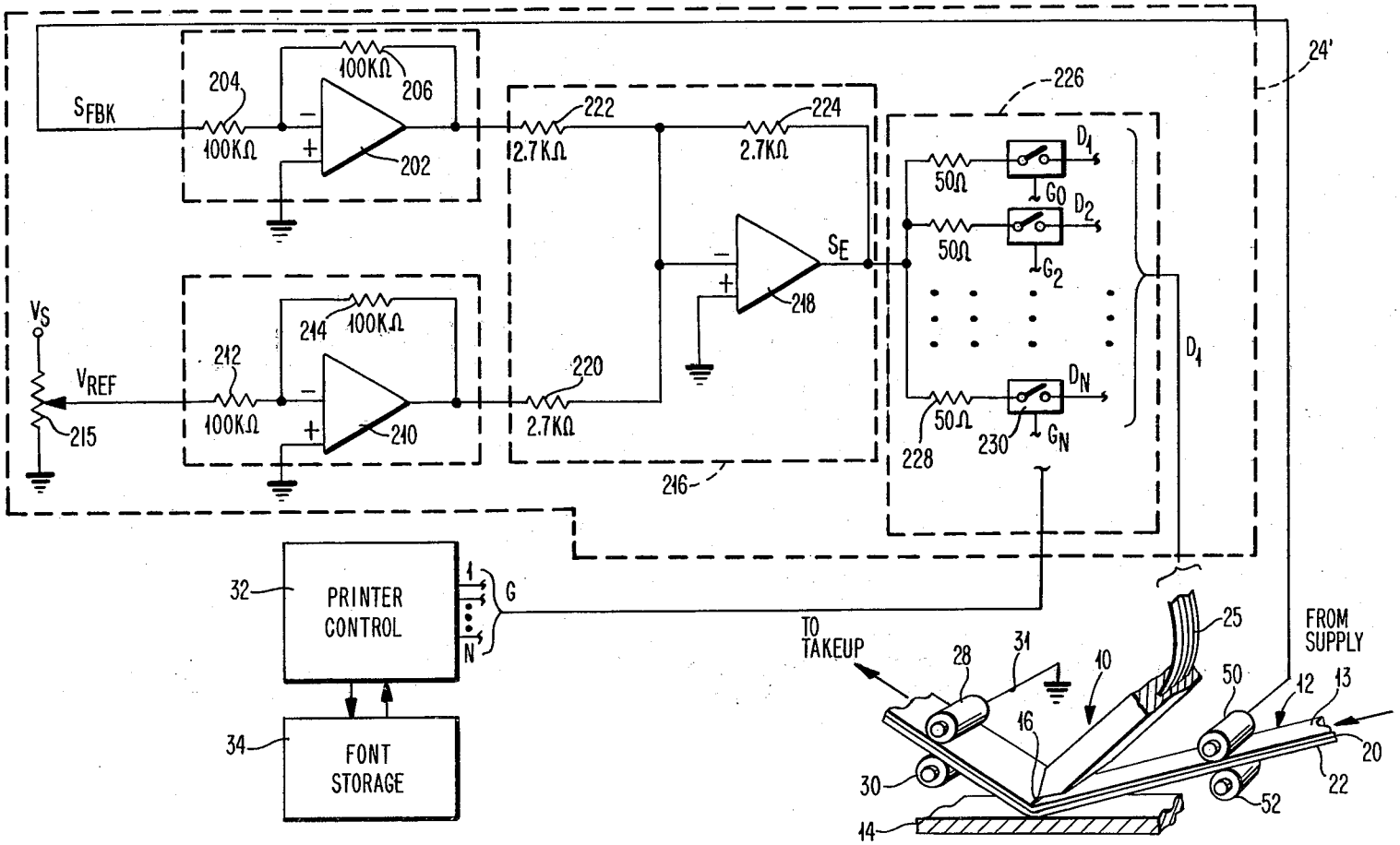
FIG. 2 is a diagram partially in block form indicating a presently preferred electrode energization arrangement for a resistive ribbon printer.

Referring to FIG. 2, printhead energization means 24' according to a presently preferred implementation for the invention receives a feedback signal $S_{FBK}$ from a monitor contact means 50 which is preferably an electrically conducting roller that cooperates with a pressure roller 52. The roller 50 is preferably located on the path of the ribbon 12 at a position on the opposite side of the printhead 10 from the drive signal collector contact means 28. By so locating the monitoring point, it is possible to monitor a voltage level that is essentially the voltage of the conducting layer 20 at the printing zone (at the printhead 10), as is explained below.

Figure 3:
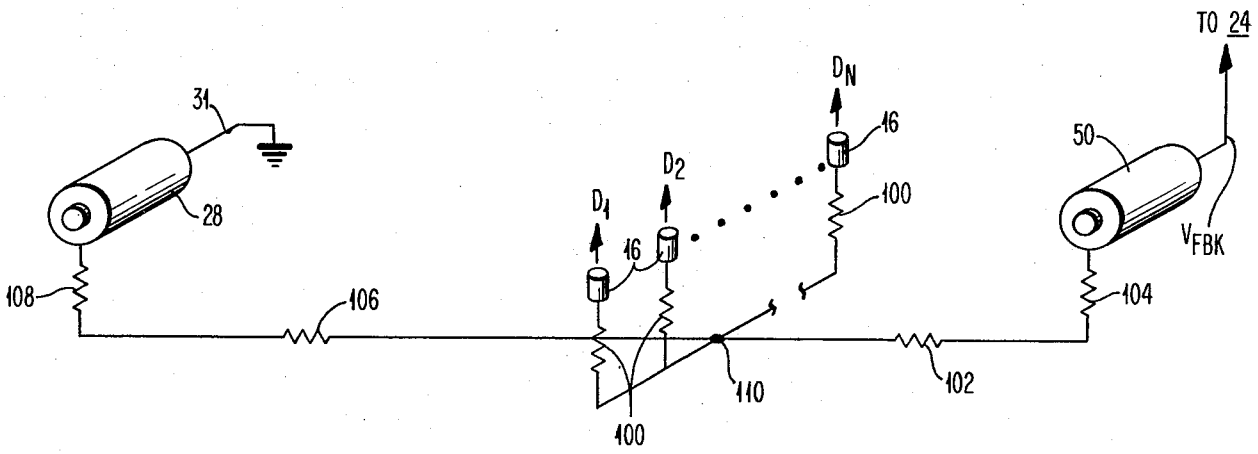
FIG. 3 is a diagram useful for discussing electrical current flows for the presently preferred electrode energization arrangement.

To facilitate an explanation of this ability to monitor the buried layer, a simplified lumped parameter representation for the ribbon 12 is discussed with reference to FIG. 3. A set of resistors 100 represent the path resistances between the electrodes 16 and the highly conducting layer 20. The resistance of the highly conducting layer 20 between the printing zone and the contact zone at the monitor contact means 50 is represented by a resistor 102 and a resistor 104 represents the resistance through the moderately resistive layer 18 to the monitor contact means 50.

In the opposite direction, there is represented, by a resistor 106, the resistance of the highly conducting layer section extending from the print zone to the contact zone for the contacting means 28. A resistor 108 represents the resistance through the moderately resistive layer 18 at the contact zone for the contact means 28. While it is possible as a consequence of the distributed nature of the ribbon resistances to identify other signal paths, they tend to be of less significance to the voltage levels of concern than those mentioned above.

It is seen from the diagram that for a relatively high impedance at the monitor contact means 50, the current for the drive signals D would predominantly follow the path through the resistors 106 and 108 to the collector means 28 which offers a low impedance connection back to energization means 24'. This current flow for the drive signals D establishes a voltage at a node 110 which node essentially corresponds to the conducting layer 20 at the print zone. Since, for a high impedance connection to the connecting means 50, insignificant current would flow through the resistors 102 and 104 to produce a voltage drop, the voltage signal $V_{FBK}$ would essentially correspond to the voltage at the node 110.

While the above development is not rigorous, it is thought to be helpful toward an understanding of the mechanism by which a meaningful signal $S_{FBK}$ is obtained. Also, it can be appreciated that the contacting means 50 should be located on the ribbon path to allow monitoring the entire voltage drop from conducting layer 20 at the print zone through contact means 31 and back to energizing means 24'. This is best achieved by locating the monitor contact means 50 on the opposite side of the printhead 10 from the collector contact 28. It is preferred for the monitor contact means 50 to be on the supply side of the printhead 10 and the collector contact 28 on the takeup side, as is shown. Also, the monitor contact means 50 is spaced from the printhead 10 so that there is little or no contribution of potential resulting from migration of printing currents through the moderately conducting layer 18 that is added to the monitored potential.

Now returning to FIG. 2, the signal $S_{FBK}$ from monitor contact means 50 is supplied to monitoring means 200, that is preferably an operational amplifier 202 in a connection with a pair of resistors 204 and 206 (presently preferred resistance values are indicated) to act as a high impedance analog buffer.

A reference voltage $V_{REF}$ is supplied to an analog buffer 208 that is preferably an operational amplifier 210 in a connection with a pair of resistors 212 and 214 to act as a high impedance analog buffer. The signal $V_{REF}$ may be supplied by an operator adjustable potentiometer 215 but, alternatively, may be supplied by a controller such as a programmed microcomputer (not shown). Signals from monitoring means 200 and the buffer 208 are processed by means such as a summing circuit 216 which is preferably an operational amplifier 218 having connected at an input summing junction two input resistors 220 and 222 and a feedback resistor 224. The voltage from the buffer 200 serves as a buffered feedback, according to the invention, for cancelling all or a portion of the ribbon voltage transmitted to the monitor contact 50. The balance between the response to the signals $S_{FBK}$ and $V_{REF}$ is controlled by the relative sizes of the resistors 220 and 222 (for the presently preferred implementation equal resistances are used) and a multiplying effect on the sum is controlled by the sizing of the feedback resistor 224.

The amplifier 218 serves as the single energy source providing an energization signal $S_E$ for a selection circuit 226 that includes a balancing resistor 228 and a signal controlled switching transistor 230 for each of the respective electrode channels 25. The balancing resistors serve to balance the flow of current among the channels 25 and the transistors 230 selectively switch drive signals D in accordance with the timed signals G which as was discussed above, are generated by a print control 32.

Using the above-described feedback approach in adjusting the energization of the electrodes for a resistive ribbon thermal printer, it should be appreciated, provides satisfactory print quality without resort to customizing the energization for each electrode as occurs with a constant-current drive.

The invention has been described in detail with reference to a presently preferred implementation. However, it will be appreciated that variations and modifications are possible within the spirit and scope of the invention as identified in the claims.

What is claimed is:

1. For use in a printer of the kind that utilizes a thermal printing ribbon having a moderately conducting outer layer and a highly-conducting inner layer, said printer including a printhead with a set of electrodes that wipe over said moderately-conducting outer layer at a print zone to apply respective printing signals, timed in accordance with gating signals from a print controller, for causing localized heating within said ribbon and resultant mark formation at a receiving medium, printing signal circuitry comprising:

collection contact means for establishing electrical contact with said moderately conducting layer of said ribbon at a collection zone spaced from said print zone;

monitoring contact means for establishing electrical contact with said moderately conducting layer of said ribbon at a detection zone spaced from said print zone and said collection zone;

printhead energization means including, a high impedance circuit, connected electrically to said monitoring contact means, for producing a buffered feedback signal representative of the electric potential assumed by said monitoring contact means;

signal channels coupled to respective of said electrodes, signal processing means; responsive to said buffered feedback signal, for producing a set of printing signals, said signal processing means including means for adjusting a reference voltage level in accordance with said buffered feedback signal to produce an energization signal;

and switching means for selectively connecting said energization signal to said signal channels in accordance with said gating signals to act as respective printing signals at said electrodes; and means defining a low impedance signal return path between said collector contact means and said printhead energization means whereby a return path for said printing signals is established.

2. Printing signal circuitry according to claim 1 wherein said signal processing means is a summing circuit that combines the buffered feedback signal and a predefined reference signal in fixed proportions.

3. Printing signal circuitry according to claim 1 wherein said monitoring contact means is an electrically conducting roller that cooperates with a pressure roller to achieve intimate contact with the said moderately conducting layer of said ribbon at said detection zone.

4. Printing signal circuitry according to claims 1 or 3 wherein said collection zone is spaced in one direction along said ribbon from said print zone and said detection zone is spaced in the other direction from said print zone.

5. Printing signal circuitry according to claim 4 wherein there is a supply and a takeup direct along said ribbon and the collection zone is spaced in the takeup direction from said print zone and the detection zone is spaced in the supply direction from said print zone.

6. Printing signal apparatus for use in a printer of the kind in which a printhead including a set of electrodes wipes over an outer moderately resistive layer of a signal responsive thermal printing ribbon at a print zone, said printing signal producing apparatus comprising:

first contact means establishing electrical contact with said ribbon at a first contact zone spaced from said printhead in a first direction along the ribbon;

second contact means establishing electrical contact with said ribbon at a second contact zone spaced from said printhead in the ribbon direction opposite said first direction;

high impedance buffer means connected to said second contact means for producing a buffered feedback signal representative of the electrical potential of said ribbon at said second contact zone;

means for generating gating signals for coordinating the energization respective of said electrodes;

energization signal means for generating a voltage signal at least in part in accordance with said buffered feedback signal;

switching means for selectively applying said voltage signal to said electrodes as respective printing signals in accordance with said gating signals; and conducting means for providing a low impedance electrical connection between said first contact means and said energization signal means to provide a return path for currents resulting from said printing signals.

7. Printing signal apparatus according to claim 6 wherein said first contact means is a conducting roller that cooperates with a pressure roller to achieve intimate contact with said moderately conducting layer of said ribbon.

8. Printing signal apparatus according to claims 6 or 7 wherein said second contact means is a conducting roller that cooperates with a pressure roller to achieve intimate contact with said moderately conducting layer of said ribbon.

9. Printing signal apparatus according to claim 6 wherein said first direction is toward a ribbon takeup.

10. Printing signal apparatus according to claim 6 wherein said switching means includes individual switching devices controlled by respective of said gating signals and said switching devices are in series with current balancing resistors.

11. Printing signal apparatus according to claim 6 wherein said energization signal means includes an operational amplifier connected as a summer and said operational amplifier receives said buffered feedback signal which is inverted.

* * * * *